US006881711B1

(12) United States Patent
Gershun et al.

(10) Patent No.: US 6,881,711 B1
(45) Date of Patent: Apr. 19, 2005

(54) LOW VOC CLEANING COMPOSITIONS FOR HARD SURFACES

(75) Inventors: Aleksei V. Gershun, Southbury, CT (US); Mark V. Alexander, Bridgewater, CT (US); Colin M. Dilley, Torrington, CT (US)

(73) Assignee: Prestone Products Corporation, Danbury, CT (US)

( * ) Notice: Subject to any disclaimer, the term of this patent is extended or adjusted under 35 U.S.C. 154(b) by 137 days.

(21) Appl. No.: 10/046,867

(22) Filed: Oct. 26, 2001

(51) Int. Cl.[7] ..... C11D 1/86; C11D 3/44

(52) U.S. Cl. ..... 510/182; 510/179; 510/180; 510/181; 510/427; 510/432; 510/505

(58) Field of Search ..... 510/506, 424, 510/432, 182, 433, 427, 434

(56) References Cited

U.S. PATENT DOCUMENTS

| | | | | |
|---|---|---|---|---|
| 3,882,038 A | | 5/1975 | Clayton et al. | |
| 3,970,595 A | | 7/1976 | Ginn et al. | |
| 4,054,534 A | | 10/1977 | Angelini | |
| 4,213,873 A | | 7/1980 | Church | |
| 4,243,543 A | | 1/1981 | Guilbert | |
| 4,243,546 A | | 1/1981 | Shaer | |
| 4,315,828 A | * | 2/1982 | Church | 510/405 |
| 4,518,694 A | | 5/1985 | Shaer | |
| 4,548,727 A | | 10/1985 | Shaer | |
| 4,673,523 A | * | 6/1987 | Smith et al. | 15/104.93 |
| 4,725,489 A | | 2/1988 | Jones et al. | |
| 4,753,844 A | | 6/1988 | Jones et al. | |
| 4,952,248 A | | 8/1990 | Aberg | |
| 5,046,449 A | | 9/1991 | Nelson | |
| 5,108,660 A | * | 4/1992 | Michael | 510/428 |
| 5,128,057 A | | 7/1992 | Bixenman et al. | |
| 5,252,245 A | | 10/1993 | Garabedian, Jr. et al. | |
| 5,336,445 A | | 8/1994 | Michael et al. | |
| 5,362,422 A | * | 11/1994 | Masters | 510/424 |
| 5,364,551 A | | 11/1994 | Lentsch et al. | |
| 5,385,750 A | * | 1/1995 | Aleksejczyk et al. | 427/4 |
| 5,415,811 A | | 5/1995 | Wile et al. | |
| 5,437,807 A | | 8/1995 | Garabedian, Jr. et al. | |
| 5,454,983 A | | 10/1995 | Michael et al. | |
| 5,468,423 A | | 11/1995 | Garabedian, Jr. et al. | |
| 5,523,024 A | | 6/1996 | Garabedian, Jr. et al. | |
| 5,536,450 A | | 7/1996 | Masters et al. | |
| 5,536,451 A | | 7/1996 | Masters et al. | |
| 5,540,864 A | | 7/1996 | Michael | |
| 5,573,710 A | | 11/1996 | McDonell | |
| 5,585,342 A | | 12/1996 | Choy et al. | |
| 5,714,448 A | | 2/1998 | Choy et al. | |
| 5,753,310 A | | 5/1998 | Bakalar | |
| 5,817,615 A | | 10/1998 | Garabedian, Jr. et al. | |
| 5,851,981 A | * | 12/1998 | Choy et al. | 510/433 |
| 5,871,590 A | | 2/1999 | Hei et al. | |
| 5,922,665 A | | 7/1999 | Liu | |
| 5,998,342 A | | 12/1999 | Scoville, Jr. et al. | |
| 6,010,995 A | | 1/2000 | Van Eenam | |
| 6,191,092 B1 | | 2/2001 | Bragulla et al. | |
| 6,339,054 B1 | | 1/2002 | Levitt et al. | |
| 6,350,725 B1 | | 2/2002 | Levitt et al. | |
| 6,432,897 B1 | * | 8/2002 | Cable | 510/182 |
| 2002/0128169 A1 | | 9/2002 | Levitt et al. | |

FOREIGN PATENT DOCUMENTS

| | | |
|---|---|---|
| DE | 198 30 848 A1 | 1/2000 |
| GB | 2283982 A | 5/1995 |

OTHER PUBLICATIONS

EPA Consumer Products Rule, http://www.epa.gov/Region7/programs/artd/headliners/consumer.htm, Oct. 2000.

The California air Resources Board Mid–Term Measures II, http://www.arb.ca.gov/regact/midterm2/midterm2.htm and: http://www.arb.ca.gov/regact/midterm2/regulation.pdf, 1999.

The Ozone Transport Commission's Proposed Rule, http://www.sso.org/otc/Formal%20Actions/MOU%2001–1_controlmeasure_final. PDF, 2000.

* cited by examiner

*Primary Examiner*—Gregory Webb

(57) ABSTRACT

The present invention relates generally to compositions and methods for cleaning hard surfaces. More particularly, the present invention relates to cleaning compositions which can be used in automotive applications for removing organic soils that accumulate on automotive surfaces without causing surface paint damage. Such cleaning compositions of the present invention are environmentally safe and contain no or low amounts of volatile organic compounds.

37 Claims, No Drawings

LOW VOC CLEANING COMPOSITIONS FOR HARD SURFACES

FIELD OF THE INVENTION

The present invention relates generally to compositions and methods for cleaning hard surfaces. More particularly, the present invention relates to cleaning compositions which can be used in automotive applications for removing organic soils that accumulate on automotive surfaces without causing surface paint damage. Such cleaning compositions of the present invention are environmentally safe and contain no or low amounts of volatile organic compounds.

BACKGROUND OF THE INVENTION

Cleaning compositions for hard surfaces are known. As used herein, the term "hard surfaces" includes glass surfaces and automotive surfaces. As used herein, the term "automotive surface" includes windshields, fenders, tires, doors, roof, hood, trunk, bumpers, trim, windows, hub caps, transportation body and heat exchangers. Such cleaning compositions have been used in household or automotive applications. As used herein, the term "automotive application" includes trains, motorcycles, cars, airplanes, boats, trucks, buses and recreational sporting vehicles and related equipment (e.g., helmets).

Especially with respect to automotive applications, as well as other applications in which the surface to be cleaned is exposed to the environment, an effective cleaning composition should be capable of removing a wide variety of materials including inorganic and organic soils. Typical inorganic soils include clay, cement, industrial dust, sand, products from acid rain condensation, rock forming minerals residue and the like. Typical organic soils include those derived from rubber, asphalt, oil residue, insect residue, tree sap, bird droppings and the like.

Traditional cleaning compositions, however, typically suffer from a number of deficiencies. For example, such compositions generally contain or suggest the use of a high volatile organic compound ("VOC") content. See, e.g., U.S. Pat. Nos. 5,585,342; 5,415,811; 4,315,828; and 4,213,873. Recently, Federal and State governments have established standards that set specific VOC content limits for several categories of consumer products. See, e.g., EPA Consumer Products Rule, The California Air Resources Board Mid-Term Measures II and The Ozone Transport Commission's Proposed Rule. For example, the new California VOC content limits for non-aerosol glass cleaners and automotive windshield washer fluids are 4% and 1%, respectively, and are expected to be lower in the future. Such standards are based on a finding that VOC emissions from the use of consumer products can cause or contribute to the formation of ground level ozone ("smog").

However, it has been suggested that lowering the VOC content of traditional cleaning compositions limits their effectiveness and/or range of applications (e.g., are effective for use in light duty applications and not for removing organic soils from hard surfaces in automotive applications). For example, U.S. Pat. No. 4,725,489 ("the '489 patent") discloses disposable semi-moist wipes for light cleaning of bathroom surfaces. Such wipes carry an aqueous composition containing a VOC content (weight percent solvent) ranging from about 0.2 to about 25%. Wipes carrying a composition having a VOC content of 2.6% exhibited unsatisfactory results, whereas those having a higher VOC content (i.e., a VOC content between 5–7%) exhibited improved results. Similarly, U.S. Pat. No. 4,753,844 ("the '844 patent") discloses semi-moist wipes for interim cleaning of kitchen surfaces. Such wipes, comprising a "heavy duty" cleaner, have a VOC content ranging from 5–70%.

Although other traditional cleaning compositions are generically described as having a broad range of VOC content, including possibly having a relatively low VOC content, the only specific compositions disclosed as being useful to clean hard surfaces have much higher and prohibitive VOC content. And, none of these disclosed compositions have been shown to be effective in automotive applications.

For example, U.S. Pat. No. 5,437,807 ("the '807 patent") discloses generally hard surface cleaners comprising, inter alia, an "effective amount" of a solvent in the cleaner with a solvent limit (VOC content) of no more than 50%. However, the '807 patent specifically teaches cleaners comprising approximately 10% solvent. Similarly, U.S. Pat. Nos. 4,315,828 ("the '828 patent") and 4,054,534 ("the '534 patent") relate generally to cleaning compositions which may contain a wide range of solvent. The preferred compositions of, and all those specifically disclosed in, the '828 and '534 patents contain, respectively, about 7–15% by weight solvent and 30–95 parts per volume of alcohol per 70–75 parts per volume of water.

Thus, a problem currently facing manufacturers of cleaning products is the need to comply with the new VOC restrictions while, at the same time, maintaining cleaning effectiveness. This problem is especially significant with respect to cleaning products for automotive applications. In addition to the high VOC problem, traditional cleaners for automotive applications, although they are satisfactory in removing inorganic soils from hard surfaces, are often unsatisfactory in removing organic soils. Further, the cleaners currently used, which have a high VOC content, may cause damage to the paint finish.

Manufacturers have attempted to solve these problems by reformulating their existing cleaning compositions in order to lower the VOC content. For example, some windshield washer fluids have been reformulated to contain only "blue" or "green" water (i.e., water containing a blue or green dye) (CLEARLY VISIBLE® Summer Formula from Chem Lab Products, Penske Premium Bug Remover). Other compositions have been reformulated to contain a very small amount of solvent (Splash from FOX Packaging). Unfortunately, these low VOC reformulations have a number of deficiencies including limited cleaning effectiveness especially for organic soils on hard surfaces.

Manufacturers have also attempted to solve the low VOC problem by developing new products. For example, U.S. Pat. No. 6,010,995 discloses an aqueous cleaning/degreasing composition in the form of a macroemulsion comprising a nonionic surfactant and a hydrophobe having specifically enumerated characteristics. Although such compositions contain no or low amounts of VOCs, their effectiveness is limited to cleaning soils derived from Vaseline brand petroleum jelly, ball point pens and felt tip markers and are not effective for cleaning organic soils from hard surfaces.

Additional efforts to effectively remove organic soils from hard surfaces, especially in automotive applications, have other deficiencies. For example, one method for protecting a surface from soils is to apply a protective coating, such as waxes and rinses, to create a water-repellant surface. However, these agents are only minimally effective in removing organic soils.

U.S. Pat. No. 5,871,590 discloses a touchless car wash system in which a composition comprising an ether amine or alkyl ether diamine, a stabilizer and water is sprayed or wiped onto an automotive surface to remove soil. The composition is then removed from the surface using an aqueous rinse. Similarly, U.S. Pat. No. 5,753,310 discloses a method of protecting a vehicle from organic soils in which the vehicle surface is treated with a lecithin and vegetable oil containing composition. See also, U.S. Pat. No. 5,046,449. The treated surface is then easily cleaned of organic soils by rinsing or washing. However, these methods have a number of limitations including the need to use a second rinsing/washing step and the need to reapply the protective coating for future cleaning.

Another method for removing organic soils from automotive surfaces involves the use of compositions containing enzymes. For example, GB 2,283,982 A discloses a two-step method for cleaning a surface carrying a proteinaceous material, comprising applying to the surface an aqueous enzyme formulation, which does not contain surfactant or solvent, to digest the material, and then wiping the surface. Similarly, DE 198 30 848 A1 discloses a surface treatment method in which a formulation containing active enzymes is applied to the surface and the enzymes adhere to the surface in an active immobilized form. Such methods suffer from several deficiencies. First, where the enzyme cleaning formulation does not contain a surfactant or solvent, the ability of the formulation to wet the surface is limited, and consequently, the cleaning formulation coats the surface only where it is applied. The effectiveness of the enzyme is therefore limited to where the cleaning formulation is applied. This is further limited by the ability of the cleaning formulation to penetrate the insect residue, which can require a significant amount of time because insect residues dry very quickly and create a wax-like barrier on the surface that is difficult to penetrate. In addition, such compositions are effective for a limited period of time—the time during which the cleaning formulation is in contact with the insect residue. Further, where the surface is pre-treated with an enzyme formulation, as in DE 198 30 848 A1, enzyme activity decreases with time, especially under the harsh environmental conditions to which automobiles are constantly exposed, such as solar radiation, rapid heating and cooling, erosion by rain and others.

Thus, there remains a need for an effective hard surface cleaner that meets the new governmental VOC content regulations.

SUMMARY OF THE INVENTION

One objective of this invention is to provide an effective hard surface cleaning composition that meets the new VOC content regulations.

It is another objective of this invention to provide a hard surface cleaning composition for removing organic soils that accumulate on vehicle surfaces without causing surface paint damage.

It is a further objective of this invention to provide compositions for cleaning hard surfaces comprising (a) about 0.001% to about 0.5% by weight of a surfactant; (b) about 0.001% to about 2% by weight of an ammonia compound; (c) about 0.001% to about 1% by weight of an alcohol; and (d) balance being water.

Another objective of this invention is to provide methods of using the compositions for cleaning hard surfaces, particularly those found in automotive applications.

DETAILED DESCRIPTION

In order that this invention may be more fly understood, the following detailed description is set forth. However, the detailed description is not intended to limit the inventions that are described by the claims.

The present invention provides low VOC hard surface cleaning compositions that exhibit superior cleaning efficacy. More particularly, the present invention provides compositions for cleaning hard surfaces, comprising:

(a) about 0.001% to about 0.5% by weight of a surfactant;

(b) about 0.001% to about 2% by weight of an ammonia compound;

(c) about 0.001% to about 1% by weight of an alcohol; and (d) balance being water.

The cleaning compositions are particularly well suited for use in automotive applications to remove organic soils that accumulate on automotive surfaces without damaging the paint finish. Such cleaning compositions of the present invention are environmentally safe and contain no or low amounts of VOC S.

The first component in the compositions of this invention is a surfactant. Suitable surfactants include, but are not limited to, nonionic surfactants, anionic surfactants, cationic surfactants, zwitterionic surfactants and mixtures thereof. Suitable surfactants include, but are not limited to, TRITON® X-100 from Union Carbide/Dow Chemical; POLYTERGENT® series from Olin Chemical; TERGITOL® series from Union Carbide/Dow Chemical; PLURONIC® surfactants from BASF Wyandotte Corp., IGEPAL® series from GAF Corp.; DC silicone-glycol copolymers from Dow Corning Corp.; NEODOL® series from Shell Chemical Co.; Diacid series from Westvaco Corporation, Lonzaine® CO from Lonza Chemical Co., VELVETEX® from Henkel KGaA; Witcolate LCP and REWOTERIC® from Witco Chemical Co.; DEHYPOUND® HSC 5515 and GLUCOPON® from Cognis Corporation; AO-14-2, Q-14-2, Tomadine 101 LF, Alkali Surfactant NM and Amphoteric L from Tomah Products, Inc; and mixtures thereof. Preferred mixtures contain Q-14-2 and AO-14-2; Q-14-2 and Amphoteric L; and Q-14-2 and Alkali Surfactant NM. Such mixtures are collectively referred to as "CS Surfactant."

Preferably, the surfactant is present in the composition in the amount of about 0.001% to about 0.25% (by weight), and more preferably, about 0.005% to about 0.1%. Even more preferably, the surfactant is present in the amount of about 0.01% to about 0.075%, and yet even more preferably, about 0.01% to about 0.05%.

The second component in the composition of this invention is an ammonia compound. Suitable ammonia compounds include, but are not limited to, ammonium carbamate, ammonium carbonate, ammonium bicarbonate, ammonium hydroxide, ammonium acetate, ammonium borate, ammonium phosphate, alkanolamines having 1 to 6 carbon atoms, ammonia (which forms ammonium hydroxide in situ when added to water). Preferably, ammonia, ammonium hydroxide or an alkanolamine is used. A preferred alkanolamine is 1-amino-2-propanol.

Preferably, the ammonia compound is present in the composition in the amount of about 0.005% to about 1.0% (by weight of $NH_3$), and more preferably, about 0.01% to about 0.75%. Even more preferably, the ammonia compound is present in the amount of about 0.05% to about 0.50%, and yet even more preferably, about 0.07% to about 0.30%.

The third component in the compositions of this invention is an alcohol. Suitable alcohols include, but are not limited to, water miscible alcohols having 1 to 6 carbon atoms, water miscible glycols and glycol ethers having 2 to 15 carbon atoms and mixtures thereof. Preferred alcohols include methanol, ethanol, isopropanol, propanol, butanol, furfuryl alcohol, tetrahydrofurfuryl alcohol ("THFA") and 1-amino-2-propanol. Preferred glycols and glycol ethers include ethylene glycol, propylene glycol, 2-butoxyethanol sold as BUTYL CELLOSOLVE®, 2-methoxyethanol, 1-methoxy-2-propanol, ethylene glycol dimethyl ether, 1,2-dimethoxypropane, 2-(2-propoxyethoxy)ethanol, 2-[2-(2-propoxyethoxy)ethoxy]ethanol, 2-(2-isopropoxyethoxy)ethanol, 2-[2-(2 isopropoxyethoxy)ethoxy]ethanol, 2-(2-butoxyethoxy)ethanol, 2-[2-(2-butoxyethoxy)ethoxy]ethanol, 2-(2-isobutoxyethoxy)ethanol, 2-[2-(2 isobutoxyethoxy)ethoxy]ethanol, 2-(2-propoxypropoxy)-propan-1-ol, 2-[2-(2-propoxypropoxy)propoxy]propan-1-ol, 2-(2-isopropoxypropoxy)-propan-1-ol, 2-[2(2-isopropoxypropoxy)propoxy]propan-1-ol, 2-(2-butoxypropoxy)-propan-1-ol, 2-[2(2-butoxypropoxy)propoxy]propan-1-ol, 2-(2-isobutoxypropoxy)-propan-1-ol and 2[2-(2-isobutoxypropoxy)propoxy]propan-1-ol. Preferably, ethanol, isopropanol, 2-butoxyethanol or 1-amino-2-propanol is used.

Preferably, the alcohol is present in the composition in the amount of about 0.005% to about 0.80/(by weight), and more preferably, about 0.01% to about 0.70%. Even more preferably, the alcohol is present in amount of about 0.05% to about 0.60%, and yet even more preferably, about 0.1% to about 0.50%.

It is contemplated that a single compound may serve as both the alcohol and the ammonia components. Such a compound includes, but is not limited to, an alkanolamine having 1 to 6 carbon atoms. A preferred alkanolamine is 1-amino-2-propanol.

Preferably, the alcohol/ammonia containing compound is present in the composition in the amount of about 0.005% to about 0.80% (by weight), and more preferably, about 0.01% to about 0.70%. Even more preferably, the alcohol/ammonia containing compound is present in amount of about 0.05% to about 0.60%, and yet even more preferably, about 0.1% to about 0.50%.

Preferred compositions of this invention, especially for use in automotive applications to remove organic soils from automotive surfaces (particularly windshields), are described below.

One preferred composition comprises:

(a) about 0.001% to about 0.25% by weight of a surfactant;

(b) about 0.005% to about 1.0% by weight of an ammonia compound;

(c) about 0.005% to about 0.80% by weight of an alcohol; and (d) balance being water.

A more preferred composition comprises:

(a) about 0.005% to about 0.1% by weight of a surfactant;

(b) about 0.01% to about 0.75% by weight of an ammonia compound;

(c) about 0.01% to about 0.70% by weight of an alcohol; and (d) balance being water.

An even more preferred composition comprises:

(a) about 0.01% to about 0.075% by weight of a surfactant;

(b) about 0.05% to about 0.50% by weight of an ammonia compound;

(c) about 0.05% to about 0.600/% by weight of an alcohol; and (d) balance being water.

Yet an even more preferred composition comprises:

(a) about 0.01% to about 0.05% by weight of a surfactant;

(b) about 0.07% to about 0.30% by weight of an ammonia compound;

(c) about 0.1% to about 0.50% by weight of an alcohol; and (d) balance being water.

The compositions of this invention may also include, as an optional component, one or more enzymes to degrade or breakdown organic materials in the soil. Suitable enzymes include, but are not limited to, proteases, cellulases, chitinases, lipases, and amylases. Such enzymes may be added at concentrations up to about 0.03% (by weight), and preferably in the amount of about 0.001% to about 0.02%.

The compositions of this invention may also include, as optional components, one or more additional additives. Such additives include, but are not limited to, dyes (e.g., "Alizarine Green" or "Uranine Yellow" from Abbey Color Inc.; "Chromatint Green X-1102" from Chromotech Inc.; "Acid Orange 7" or "Intraacid Rhodamine WT" (Acid Red 388) from Crompton & Knowles Corp; and "Acid Green" from BASF); fragrances (e.g., floral or tree oils, such as pine, rose oil, lilac, jasmine, wisteria, lemon, apple blossoms, compound bouquets, such as spice, woody, oriental and the like from Alfa Aromatics and Alpine Aromatics); antifoaming agents (e.g., PM-5150 from Union Carbide/Dow Chemical; SAG-2001 or Silweet L-7220 from Witco Chemical Co.; Y-3D and DC-Q2-5067,1510-US, BOT or 454G-CTN from Dow Corning; PLURONIC® L-61 from BASF Corp.; PI-35150 from Ultra Additive; and Patco-492 or Patco 415 from American Ingredients Company); and/or thickening agents (e.g., CALAMIDE® C from Pilot Chemical Co.; CELLOSIZE® Hydroxyethyl from Union Carbide/Dow; Crothix or Incromate ISML from Croda Inc.; Carbopols from BF Goodrich Co.; Jaguar HR-10S or Lapanite RDS/XLG from Southern Clay Products; LIPOMIC® 601 from Lipo Chemical Inc.; and NINOL® SR 100 from Stepan Company).

This invention also provides methods for cleaning hard surfaces. In one embodiment, the cleaning method comprises the steps of: (1) applying the inventive compositions described herein to the hard surface; and (2) wiping the surface. The compositions and methods of this invention are preferably used in automotive applications to remove organic soils from automotive surfaces, and more preferably, to remove organic soils from windshields. The compositions and methods of this invention provide effective cleaning of organic soils without damaging the surface being cleaning or the surrounding surface including the paint finish.

In order that this invention may be better understood, the following examples are set forth.

EXAMPLES

Thirty-four different cleaning compositions were prepared (Examples 1–34). The components of these compositions are described in Table 1 below. Examples 1–5 and 32–34, as shown in Tables 1a and 1f, correspond to known windshield washer fluids and are used as control compositions.

TABLE 1a

| Weight % | Example 1 | Example 2 | Example 3 | Example 4 | Example 5 | Example 6 | Example 7 |
|---|---|---|---|---|---|---|---|
| Water | 100 | 96.22 | 90.4 | 99.84 | 99 | 82.724 | 91.064 |
| Methanol | — | 3.7 | 9.6 | — | 1 | 16.0 | 7.6 |
| TRITON ® X-100 | — | 0.08 | — | — | — | 0.026 | 0.036 |
| BUTYL CELLOSOLVE ® | — | — | — | — | — | 1.25 | 1.3 |
| Ammonia[1] | — | — | — | 0.16 | — | — | — |
| Dye | — | trace | trace | trace | trace | trace | trace |

[1]Source of ammonia is 28% $NH_3$ in water

TABLE 1b

| Weight % | Example 8 | Example 9 | Example 10 | Example 11 | Example 12 | Example 13 | Example 14 |
|---|---|---|---|---|---|---|---|
| Water | 99.27 | 99.78 | 99.21 | 98.9 | 98.61 | 99.8 | 99.76 |
| TRITON ® X-100 | 0.03 | 0.02 | 0.01 | — | 0.01 | 0.06 | 0.06 |
| BUTYL CELLOSOLVE ® | — | — | 0.5 | — | — | — | — |
| THFA | — | — | — | 1.1 | 1.1 | — | — |
| Ammonia[1] | 0.7 | 0.2 | 0.28 | — | 0.28 | 0.14 | 0.14 |
| Enzyme | — | — | — | — | — | — | 0.01 |
| Dye | trace | trace | trace | trace | trace | trace | trace |

[1]Source of ammonia is 28% $NH_3$ in water

TABLE 1c

| Weight % | Example 15 | Example 16 | Example 17 | Example 18 | Example 19 | Example 20 | Example 21 |
|---|---|---|---|---|---|---|---|
| Water | 99.81 | 99.81 | 99.666 | 99.5 | 99.86 | 99.96 | 99.96 |
| 1-amino-2-propanol | — | — | 0.2 | 0.5 | — | — | — |
| Surfactant | 0.04[2] | 0.04[3] | 0.04[4] | — | — | 0.04[5] | 0.04[6] |
| Ammonia[1] | 0.14 | 0.14 | 0.084 | — | 0.14 | — | — |
| Dye | trace | trace | trace | — | — | — | — |
| Fragrance | 0.01 | 0.01 | 0.01 | — | — | — | — |

[1]Source of ammonia is 28% $NH_3$ in water
[2]TRITON ® X-100
[3]TRITON ® X-100
[4]Mixture of DEHYPOUND ® HSC 5515 and Witcolate LCP
[5]DEHYPOUND ® HSC 5515
[6]AO-14-2

TABLE 1d

| Weight % | Example 22 | Example 23 | Example 24 | Example 25 | Example 26 |
|---|---|---|---|---|---|
| Water | 99.96 | 99.96 | 99.96 | 99.68 | 99.68 |
| Surfactant | 0.04[2] | 0.04[3] | 0.04[4] | 0.04[5] | 0.04[6] |
| Ammonia[1] | — | — | — | 0.28 | 0.28 |

[1]Source of ammonia is 28% $NH_3$ in water
[2]Tomadine 101 LF
[3]Q-14-2
[4]Alkali Surfactant NM
[5]CS Surfactant
[6]DEHYPOUND ® HSC 5515

TABLE 1e

| Weight % | Example 27 | Example 28 | Example 29 | Example 30 | Example 31 |
|---|---|---|---|---|---|
| Water | 99.58 | 99.82 | 99.78 | 99.797 | 99.656 |
| 1-amino-2-propanol | 0.1 | — | — | — | 0.2 |
| Surfactant | 0.04[2] | 0.04[3] | 0.04[4] | 0.05[5] | 0.05[6] |
| Ammonia[1] | 0.28 | 0.14 | 0.14 | 0.14 | 0.084 |

TABLE 1e-continued

| Weight % | Example 27 | Example 28 | Example 29 | Example 30 | Example 31 |
|---|---|---|---|---|---|
| Fragrance | — | — | 0.04 | 0.01 | 0.005 |
| Antifoam | — | — | — | 0.003 | 0.005 |

[1]Source of ammonia is 28% $NH_3$ in water
[2]Mixture of DEHYPOUND ® HSC 5515 and Witcolate LCP
[3]Amphoteric L
[4]DEHYPOUND ® HSC 5515
[5]Mixture of Alkali Surfactant NM and Witcolate LCP
[6]Mixture of DEHYPOUND ® HSC 5515 and Witcolate LCP TABLE 1f

| Weight % | Example 32 | Example 33 | Example 34 |
|---|---|---|---|
| Water | 72.1 | 99.979 | 92.799 |
| Methanol | 27.9 | — | 6.0 |
| Surfactant | — | — | 0.001[1] |

TABLE 1f-continued

| Weight % | Example 32 | Example 33 | Example 34 |
|---|---|---|---|
| Ammonia | — | 0.021 | — |
| EG/Monobutyl Ether | — | — | 1.2 |

[1]Coco fatty acid ester compound

Each of the compositions was prepared in a mixing vessel at room temperature at least one hour prior to use. All of the components were obtained commercially as follows: methanol from Aldrich Chemical Company Inc.; TRITON® X-100 from Union Carbide/Dow Chemical, BUTYL CELLOSOLVE® from Union Carbide/Dow Chemical; ammonia from Aldrich Chemical Company Inc.; THFA from Penn Specialty Chemical Inc.; Enzyme plus from Chem Masters, Inc.; 1-amino-2propanol from Aldrich Chemical Company Inc.; DEHYPOUND® HSC 5515 from Cognis Corporation; Witcolate LCP from Witco; AO-14-2 from Tomah Products; Inc.; Q-14-2 from Tomah Products; Tomadine 101 LF from Tomah Products, Inc.; Alkali Surfactant NM from Tomah Products, Inc.; and Amphoteric L from Tomah Products, Inc.

After preparation, each composition was evaluated for its ability to remove organic soils ("Cleaning Evaluation Test"); its effect on painted surfaces ("Paint Damage Test"); its ability to remove organic soils on a simulated windshield ("Automotive Windshield Test"); and its performance in an automotive fleet test ("Automotive Fleet Test"). These tests are described in detail below.

Preparation of Organic Soil Samples

The following protocol was used to prepare "bug juice" used in the tests described below. A known quantity of house crickets (Acheta domesticus) was placed in a laboratory freezer at 32° F. A small electrical blender was used to blend one part by weight of the crickets with four parts by weight of water for at least one minute. The liquid part of the blended mixture was transferred to a centrifuge tube and centrifuged at 2000 RPM for at least 20 minutes. Middle supernatant layers from the centrifuge tube were collected and used as "bug juice."

A known amount of bug juice (at least $1.5\times10^{-3}$ g±0.0004) was applied horizontally to the middle of a standard 22-mm$^2$-glass cover slip (at least 2 mm from the bottom and not less than 12 mm from the top) using a disposable plastic pipette. The glass cover slip was then dried in a 110° F. oven for two hours or dried at room temperature for at least two hours.

The following protocol was used to prepare "tree sap" used in the tests described below. Ten parts by weight of dried tree resin from Pine trees (Common Name: Eastern White Pine; Botanical Name: *Pinus strobus L*) were blended with one part of 1-t-butoxy-2-propanol (Arco Chemical Company) for 20 minutes at 65° C. The mixture was then transferred to a filter funnel equipped with 40-micron filter paper. The filtrate was collected and used as "tree sap."

Tree sap solution was applied horizontally to the middle of a standard 22-mm$^2$-glass cover slip (at least 2 mm from the bottom and not less than 12 mm from the top) between two strips of electrical tape (thickness 0.14 mm). Tree sap solution above the level of the electrical tape was scraped off in order to produce a uniformly thick layer of tree sap (thickness 0.14 mm). The glass cover slip was allowed to air dry for twenty-four hours.

The following protocol was used to prepare "bird droppings" used in the tests described below. One part by weight of bird droppings from Canadian Geese was blended with one part water for 60 seconds. The resulting solution was used as "bird droppings."

A known amount of bird dropping solution (at least $1.5\times10^{-3}$ g±0.0004) was applied horizontally to the middle of a standard 22-mm$^2$-glass cover slip (at least 2 mm from the bottom and not less than 12 mm from the top) using a disposable plastic pipette. The glass cover slip was then dried in a 110° F. oven for two hours.

Cleaning Evaluation Test

A new method for evaluating cleaning effectiveness was developed as described herein. This method is a fast, reproducible and inexpensive way to evaluate the effectiveness of hard surface cleaners. Prior to applicants' method, hard surface cleaners were evaluated by visual inspection and graded either on a numerical scale or on a pass/fail scale. Such a method is subjective and can lead to inconsistent results.

In general, the cleaning evaluation test of the present invention consists of determining the rate of penetration of a test cleaning composition into an organic soil and determining the percent removal effectiveness. Under the cleaning evaluation test, a penetration rate of 0.75 units and a removal effectiveness of 90% is the lowest passing value of an effective test composition.

Determination of Removal Effectiveness

An uncoated glass cover slip is placed on an analytical balance and weighed to obtain "$m_1$." The glass cover slip is then coated with an organic soil prepared above, dried and weighed to obtain "$m_2$." The weight of the organic soil "$m_{original}$" is calculated using the formula: $m_2-m_1$. The organic soiled glass cover slip is then used in the rate of penetration experiment described below. Following the completion of that experiment, the glass cover slip is dried and weighed to obtain "$m_3$." The weight of the organic soil remaining on the glass cover slip "$m_{final}$" is calculated using the formula: $m_3-m_1$. Removal effectiveness is calculated using the formula: $[(m_{original}-m_{final})/m_{original}]*100\%$.

Determination of Rate of Penetration

An organic soil coated glass cover slip is suspended from the balance in a KRUSS Processor Tensiometer K12 ("the Tensiometer") at a height just above the surface of a test cleaning composition ("the starting position"). A container filled with a test cleaning composition is raised by the Tensiometer at a rate between 0.5–14 mm/min until the soil coated region of the glass cover slip is immersed in the test cleaning composition ("the advancement step"). The container is then lowered until the glass cover slip is returned to the starting position ("the recession step"). The advancement and recession steps are repeated four times over a 5–10 minute period. Mass versus position data is collected and analyzed using KRUSS K121 software in the Standard Dynamic Contact Angle Determination mode for each advancement and recession step, generating a total of 10 plots for each glass cover slip. Rate of penetration is calculated at a specific position on the glass cover slip using the formula: $(\Delta_{original}-\Delta_{final})/\Delta_{original}$, where $\Delta_{original}$ is the difference in weight between the first advancement step and the first recession step at a pre-determined position; and where $\Delta_{final}$ is the weight difference between the last advancement step and the last recession step at that pre-determined position.

To establish the reproducibility of applicants' Evaluation Test Method, a control composition (Example 1) was prepared and evaluated for its ability to remove organic soil from six glass cover slips (bug juice as the organic soil). The results are presented below in Table 2.

TABLE 2

| Example No. | Drying Temperature[1] | $\Delta_{original}$ | $\Delta_{final}$ | Rate of Penetration[2], units | Removal Effectiveness, % |
|---|---|---|---|---|---|
| 1 | RT | 42 | 20 | 0.523 | 1 |
| (Control) | RT | 42 | 20 | 0.523 | 0 |
| | RT | 41.9 | 19.8 | 0.527 | 1 |
| | 110° F. | 42 | 20 | 0.523 | 0 |
| | 110° F. | 41.8 | 20 | 0.521 | 0 |
| | 110° F. | 42 | 20 | 0.523 | 0 |

[1]Bug juice is the organic soil.
[2]Determined at 7 mm.

As shown in Table 2, the control composition (Example 1) consistently failed to penetrate the organic soil (coefficient of penetration is approximately 0.5 units) and to remove the organic soil from the surface of the glass cover slip (coefficient of removal is 0–1%). These results demonstrate the reproducibility of applicants' Evaluation Test Method.

Having established the reproducibility of the Evaluation Test Method, the remaining thirty-three cleaning compositions were evaluated for their cleaning ability. The organic soiled glass cover slips were dried at room temperature ("RT") or at 100° F. The results are summarized below in Tables 3a and 3b.

TABLE 3a

| Example No. | Drying Temperature[1] | $\Delta_{original}$ | $\Delta_{final}$ | Rate of Penetration[2], units | Removal Effectiveness, % |
|---|---|---|---|---|---|
| 2 | RT | 40 | 18 | 0.550 | 10 |
| (Control) | 110° F. | 39 | 18 | 0.538 | 0 |
| 3 | RT | 41 | 19 | 0.536 | 0 |
| (Control) | 110° F. | 41 | 20 | 0.512 | 0 |
| 4 | RT | 35 | 5 | 0.857 | 80 |
| (Control) | 110° F. | 37 | 8 | 0.783 | 70 |
| 5 | RT | 42 | 19 | 0.547 | 5 |
| (Control) | 110° F. | 43 | 21 | 0.511 | 0 |
| 6 | RT | 43 | 22 | 0.488 | 0 |
| | 110° F. | 43 | 20 | 0.534 | 0 |
| 7 | RT | 41 | 21 | 0.487 | 0 |
| | 110° F. | 42 | 22 | 0.476 | 0 |
| 8 | RT | 38 | 2 | 0.947 | >95 |
| | 110° F. | 41 | 2 | 0.952 | 95 |
| 9 | RT | 38 | 1 | 0.974 | >95 |
| | 110° F. | 35 | 2 | 0.942 | 95 |
| 10 | RT | 37 | 0 | 1.0 | 100 |
| | 110° F. | 35 | 1 | 0.971 | >95 |
| 11 | RT | 38 | 5 | 0.868 | 45 |
| | 110° F. | 39 | 6 | 0.846 | 38 |
| 12 | RT | 38 | 0 | 1.0 | 100 |
| | 110° F. | 35 | 1 | 0.971 | >95 |
| 13 | RT | 40 | 3 | 0.925 | 57 |
| | 110° F. | 39 | 2 | 0.948 | 47 |
| 14 | RT | 37 | 0 | 1.0 | 100 |
| | 110° F. | 39 | 1 | 0.974 | >95 |

[1]Bug juice is the organic soil
[2]Determined at 7 mm

TABLE 3b

| Example No. | Drying Temperature | $\Delta_{original}$ | $\Delta_{final}$ | Rate of Penetration[4], units | Removal Effectiveness, % |
|---|---|---|---|---|---|
| 15 | RT[1] | 6.0 | 0.6 | 0.90 | 95 |
| | 110° F.[2] | 10.6 | 0.4 | 0.96 | 100 |
| | 110° F.[3] | 11.8 | 0 | 1.00 | 100 |
| 16 | RT[1] | 14.2 | 1.1 | 0.92 | 95 |
| | 110° F.[2] | 11.2 | 0 | 1.00 | 100 |

TABLE 3b-continued

| Example No. | Drying Temperature | $\Delta_{original}$ | $\Delta_{final}$ | Rate of Penetration[4], units | Removal Effectiveness, % |
|---|---|---|---|---|---|
| 17 | RT[1] | 15.6 | 0 | 1.00 | 100 |
| | 110° F.[2] | 18.2 | 0 | 1.00 | 100 |
| 18 | RT[1] | 26.5 | 2.8 | 0.89 | 80 |
| | 110° F.[2] | 25.7 | 7.3 | 0.71 | 5 |
| 19 | RT[1] | 30.2 | 1.6 | 0.94 | 5 |
| | 110° F.[2] | 35 | 12 | 0.66 | 35 |
| 20 | RT[1] | 20.4 | 2.6 | 0.87 | 0 |
| 21 | RT[1] | 15.7 | 15.7 | 0 | 0 |
| 22 | RT[1] | 9.0 | 0.9 | 0.90 | 0 |
| 23 | RT[1] | 28.09 | 28.09 | 0 | 0 |
| 24 | RT[1] | 14.96 | 14.96 | 0 | 0 |
| 25 | RT[1] | 13.1 | 0 | 1.0 | 100 |
| | 110° F.[2] | 22.1 | 6.9 | 0.69 | 72 |
| 26 | RT[1] | 18.78 | 4.60 | 0.76 | 85 |
| | 110° F.[2] | 19.3 | 4.9 | 0.74 | 83 |
| 27 | RT[1] | 14.0 | 0 | 1.0 | 100 |
| | 110° F.[2] | 14.8 | 0 | 1.0 | 100 |
| 28 | RT[1] | 14.18 | 0.18 | 0.98 | 100 |
| 29 | RT[1] | 11.21 | 0 | 1.0 | 52.9 |
| 30 | RT[1] | 14.6 | 0.92 | 0.94 | 69.23 |
| 31 | RT[1] | 14.8 | 0.18 | 0.99 | 96.0 |
| | 110° F.[2] | 20.5 | 0 | 1.0 | 100 |
| 32 | 110° F.[1] | 32 | 26 | 0.188 | 2.17 |
| (Control) | 110° F.[2] | 29 | 23 | 0.207 | 25 |
| 33 | 110° F.[1] | 20 | 12 | 0.4 | 2.0 |
| (Control) | 110° F.[2] | 28 | 10 | 0.642 | 25.5 |
| 34 | 110° F.[1] | 35 | 30 | 0.143 | 0 |
| (Control) | 110° F.[2] | 24 | 15 | 0.375 | 24.2 |

[1]Tree sap is the organic soil;
[2]Bug juice is the organic soil;
[3]Bird droppings are the organic soil;
[4]Determined at 7 mm.

As shown in Tables 3a and 3b, applicants' Evaluation Test Method provides clear distinctions between positive and negative results. For example, Examples 2–7, 13, 18–24, 26, 29–30 and 32–34 fail the cleaning evaluation test, exhibiting low penetration rates and minimal removal effectiveness. In contrast, Examples 8–10, 12, 14–17, 27–28 and 31 have high penetration rates and sufficient removal effectiveness.

Cleaning compositions comprising water (Example 1); water and alcohol (Examples 3, 5, 11, 18, and 32); water and surfactant (Examples 20–24); water and ammonia (Examples 4, 19 and 33); water, alcohol and surfactant (Examples 2, 6, 7 and 34) all failed the cleaning evaluation test (i.e., exhibited a penetration rate <0.75 units and a removal effectiveness <90%). However, each of the compositions comprising the combination of surfactant, alcohol, ammonia and water (Examples 10, 12, 17, 27 and 31) exhibited superior cleaning performance, having high penetration rates and removal effectiveness. All of these compositions have a VOC<4% and thus, satisfy the low VOC requirements for glass cleaners. And, each of these compositions, except for Example 12, meet the VOC requirement for washer fluids (VOC content<1%).

Compositions comprising a surfactant, ammonia and water (Examples 8, 9, 15, 16 and 28) also exhibited relatively high penetration rates and removal effectiveness. However, such compositions (which do not include alcohol) are not believed to be effective for removal of other types of soils common on automotive surfaces, such as those derived from rubber, asphalt, oil residue and the like.

Paint Damage Test

Paint panels of various colors (black, white and red), including clear coated and non-clear coated, were obtained from General Motors, Ford Motor Company and DaimlerChrysler. The panels were heated to approximately 140° F., the approximate temperature reached by an automobile parked in the sun. Ten drops of cleaning composition were placed on the heated paint panel and dried for 40 minutes. The panel was then cleaned with deionized water and a soft cloth and microscopically analyzed for paint damage. Under the paint damage test, cleaning compositions that cause blistering, cracking or discoloring fail.

The thirty-four cleaning compositions were evaluated for paint damage. The results are set forth in Table 4.

TABLE 4

| Example No. | Paint Damage Test | Example No. | Paint Damage Test |
|---|---|---|---|
| 1 | PASS | 18 | PASS |
| 2 | FAIL | 19 | PASS |
| 3 | PASS | 20 | PASS |
| 4 | PASS | 21 | PASS |
| 5 | PASS | 22 | PASS |
| 6 | FAIL | 23 | PASS |
| 7 | FAIL | 24 | PASS |
| 8 | PASS | 25 | PASS |
| 9 | PASS | 26 | PASS |
| 10 | PASS | 27 | PASS |
| 11 | FAIL | 28 | PASS |
| 12 | FAIL | 29 | PASS |
| 13 | FAIL | 30 | PASS |
| 14 | FAIL | 31 | PASS |
| 15 | PASS | 32 | PASS |
| 16 | PASS | 33 | PASS |
| 17 | PASS | 34 | PASS |

As shown in Table 4, Examples 2, 6, 7 and 11–14 fail the paint damage test. Of these seven compositions, two passed the Evaluation Test Method (Examples 12 and 14). The paint damage test may therefore be used in conjunction with the Evaluation Test Method to select effective cleaning compositions that do not cause paint damage.

Automotive Windshield Test

To further validate applicants' Evaluation Test Method, cleaning compositions were further evaluated in an automotive windshield test. In general, this test measures the removal effectiveness of the cleaning compositions on a simulated windshield. Removal effectiveness is determined by visual inspection and graded on a scale from 1 to 100 (discussed below).

This test simulates the complete washing action on an automobile windshield (e.g., windshield angle; wiper type, speed and pressure; washer fluid spray pattern, force and delivery rate) using actual automobile parts. The windshield test also simulates organic soil patterns on a windshield by applying the soil to random locations. The light and temperature conditions simulate those of a hot day.

The following protocol was used to prepare bug soiled windshield. A bug juice solution (prepared as described above) was applied dropwise across the windshield at 12 locations (one drop per location). The windshield was then dried in a 110° F. oven for 40 minutes.

The following protocol was used to prepare the tree sap soiled windshield. A tree sap solution (prepared as described above) was applied to the windshield in a hole (diameter 0.75 cm) punched out of electrical tape (thickness 0.14 mm) at 12 locations on the windshield. Tree sap solution above the level of the electrical tape was scraped off in order to produce a uniformly thick layer of tree sap (diameter 0.75 cm and thickness 0.14 mm). The windshield was allowed to dry at 140° F. for 40 minutes.

In the automotive windshield test, the cleaning composition was continuously sprayed on the windshield. The washer mechanism was then activated for 5 wipes of the wiper blade. Next, the spray was stopped and the washer mechanism was activated for 2 additional wipes. This cycle was repeated three times.

Removal effectiveness was determined by placing graph paper having 1.0 mm×1.0 mm squares behind the soiled windshield. The graph paper was first marked with a 0.7 cm circle to indicate the initial size and location of each organic soil. Typically, the area covered by the organic soil was approximately 50 whole or part squares. The soiled windshield was then used in one cycle of the automotive windshield test. After each cycle, the size of each organic soil was determined. Removal effectiveness was determined by counting the number of ½ squares on the graph paper of clear glass. This protocol determines removal effectiveness with an accuracy of 1%.

Removal effectiveness was determined at each location for four cycles. The results for Examples 17 and 18 are set forth in Table 5.

TABLE 5

| | | EXAMPLE 17 | | EXAMPLE 18 | |
|---|---|---|---|---|---|
| | | Bug Juice | | | |
| Location | Cycle | Removal Effectiveness | Tree Sap Removal Effectiveness | Bug Juice Removal Effectiveness | Tree Sap Removal Effectiveness |
| 1 | 1 | 0 | 60 | 0 | 0 |
| | 2 | 10 | 80 | 5 | 0 |
| | 3 | 20 | 90 | 5 | 0 |
| | 4 | 100 | 95 | 10 | 0 |
| 2 | 1 | 40 | 50 | 0 | 0 |
| | 2 | 40 | 50 | 0 | 0 |
| | 3 | 80 | 80 | 5 | 0 |
| | 4 | 100 | 100 | 5 | 0 |
| 3 | 1 | 0 | 40 | 0 | 0 |
| | 2 | 60 | 100 | 0 | 0 |
| | 3 | 90 | 100 | 0 | 0 |
| | 4 | 100 | 100 | 5 | 0 |
| 4 | 1 | 20 | 100 | 0 | 0 |
| | 2 | 40 | 100 | 0 | 0 |
| | 3 | 90 | 100 | 5 | 0 |
| | 4 | 99 | 100 | 10 | 0 |
| 5 | 1 | 10 | 100 | 0 | 0 |
| | 2 | 10 | 100 | 0 | 0 |
| | 3 | 60 | 100 | 5 | 0 |
| | 4 | 60 | 100 | 10 | 0 |
| 6 | 1 | 40 | 80 | 0 | 0 |
| | 2 | 40 | 100 | 0 | 0 |
| | 3 | 50 | 100 | 5 | 0 |
| | 4 | 80 | 100 | 5 | 0 |
| 7 | 1 | 0 | 90 | 0 | 0 |
| | 2 | 20 | 99 | 0 | 0 |
| | 3 | 70 | 99 | 5 | 0 |
| | 4 | 100 | 99 | 10 | 0 |
| 8 | 1 | 70 | 40 | 0 | 0 |
| | 2 | 80 | 80 | 0 | 0 |
| | 3 | 100 | 100 | 10 | 0 |
| | 4 | 100 | 100 | 15 | 0 |
| 9 | 1 | 70 | 10 | 0 | 0 |
| | 2 | 70 | 40 | 0 | 0 |
| | 3 | 90 | 90 | 10 | 0 |
| | 4 | 100 | 95 | 15 | 0 |
| 10 | 1 | 10 | 80 | 5 | 0 |
| | 2 | 100 | 100 | 5 | 0 |
| | 3 | 100 | 100 | 10 | 0 |
| | 4 | 100 | 100 | 15 | 0 |
| 11 | 1 | 10 | 100 | 5 | 0 |
| | 2 | 60 | 100 | 5 | 0 |
| | 3 | 80 | 100 | 15 | 0 |
| | 4 | 100 | 100 | 30 | 0 |
| 12 | 1 | 0 | 100 | 0 | 0 |
| | 2 | 40 | 100 | 5 | 0 |
| | 3 | 60 | 100 | 20 | 0 |
| | 4 | 100 | 100 | 40 | 0 |

As shown in Table 5, Example 18 fails the automotive windshield test. This result is consistent with that obtained in applicants' Evaluation Test Method. In contrast, Example 17, which demonstrated superior performance in applicants' test, passed the windshield test.

Automotive Fleet Test

Three cleaning compositions (Examples 17, 18 and 31) were evaluated in an automotive fleet test. In general, the cleaning compositions were tested and rated by drivers over a significant time period and under diverse weather and soiling conditions. Drivers rated the cleaning compositions visually on a scale from 1 to 100 for their ability to remove both organic and inorganic soils ("cleaning rating"). The results from each driver were collected and averaged ("average cleaning rating").

In the automotive fleet test, 16 vehicles were used, including trucks, light trucks, sports utility vehicles and passenger cars. The vehicles were initially cleaned to remove soils present on the windshields and to flush the fluid reservoirs and lines of pre-existing washer fluid. The windshields were cleaned using glass cleaner, followed by methanol and deionized water. The fluid reservoir and lines were flushed with deionized water and then a cleaning composition. A cleaning composition unknown to the driver was then placed in the fluid reservoir. Each driver used the unknown cleaning composition as needed and estimated the percent removal of the soil spots formed over a three week period. All the drivers rated each cleaning composition.

Examples 17 and 31 exhibited an average cleaning rating of 92%, whereas Example 18 exhibited an average cleaning rating of 32%.

One skilled in the art will appreciate that the present invention can be practiced by other than the above-described embodiments, which are presented herein for the purpose of illustration and not of limitation, and that the present invention is limited only by the claims that follow.

All references cited within the body of the instant specification are hereby incorporated by reference in their entirety.

We claim:

1. A composition for cleaning hard surfaces comprising:

(a) about 0.001% to about 0.5% by weight of a surfactant;

(b) about 0.001% to about 2% by weight of an ammonia compound;

(c) about 0.001% to about 0.80% by weight of an alcohol; and (d) balance being water, wherein the total alcohol content is no more than about 0.80% by weight of the composition.

2. The composition according to claim 1, wherein said composition comprises about 0.001 to about 0.25% by weight of surfactant.

3. The composition according to claim 1, wherein said composition comprises about 0.005% to about 0.1% by weight of surfactant.

4. The composition according to claim 1, wherein said composition comprises about 0.01% to about 0.075% by weight of surfactant.

5. The composition according to claim 1, wherein said composition comprises about 0.01% to about 0.05% by weight of surfactant.

6. The composition according to claim 1, wherein said surfactant is selected from the group consisting of nonionic surfactants, anionic surfactants, cationic surfactants, zwitterionic surfactants and mixtures thereof.

7. The composition according to claim 6, wherein said surfactant is selected from the group consisting of CS Surfactant, octylphenol ethoxylates, alkyl polyglycosides, sodium alkyl sulfates, and mixtures thereof; wherein CS Surfactant comprises a mixture of quaternary amines, amine oxides, and amphoteric surfactants.

8. The composition according to claim 1, wherein said composition comprises about 0.005% to about 1.0% by weight of the ammonia compound.

9. The composition according to claim 1, wherein said composition comprises about 0.01% to about 0.75% by weight of the ammonia compound.

10. The composition according to claim 1, wherein said composition comprises about 0.05% to about 0.50% by weight of the ammonia compound.

11. The composition according to claim 1, wherein said composition comprises about 0.07% to about 0.30% by weight of the ammonia compound.

12. The composition according to claim 1, wherein said ammonia compound is selected from the group consisting of ammonium carbamate, ammonium carbonate, ammonium bicarbonate, ammonium hydroxide, ammonium acetate, ammonium borate, ammonium phosphate, an alkanolamine having 1 to 6 carbon atoms and ammonia.

13. The composition according to claim 1, wherein said ammonia compound is selected from the group consisting of ammonia, ammonium hydroxide, and alkanolamine having 1 to 6 carbon atoms.

14. The composition according to claim 1, wherein said composition comprises about 0.005% to about 0.08% by weight alcohol.

15. The composition according to claim 1, wherein said composition comprises about 0.01% to about 0.70% by weight alcohol.

16. The composition according to claim 1, wherein said composition comprises about 0.05% to about 0.60% by weight alcohol.

17. The composition according to claim 1, wherein said composition comprises about 0.1% to about 0.50% by weight alcohol.

18. The composition according to claim 1, wherein said alcohol is selected from the group consisting of water miscible alcohols having 1 to 6 carbon atoms, water miscible glycols and glycol ethers having 2 to 15 carbon atoms and mixtures thereof.

19. The composition according to claim 1, wherein said alcohol is selected from the group consisting of methanol, ethanol, isopropanol, propanol, butanol, furfuryl alcohol, tetrahydrofurfuryl alcohol, 1-amino-2-propanol, ethylene glycol, propylene glycol, and 2butoxyethanol.

20. The composition according to claim 1, wherein said alcohol is selected from the group consisting of ethanol, isopropanol, tetrahydrofurfuryl alcohol, 1-amino-2-propanol, and 2-butoxyethanol.

21. The composition according to claim 1, wherein said composition further comprises one or more enzymes selected from the group consisting of protease, cellulase, chitinase, lipase, and amylase.

22. A composition for cleansing hard surfaces comprising:

(a) about 0.001% to about 0.25% by weight of a surfactant;

(b) about 0.005% to about 1.0% by weight of an ammonia compound;

(c) about 0.005% to about 0.80% by weight of an alcohol;

(d) balance being water;

wherein the total alcohol content is no more than about 0.80% by weight of the composition.

23. A composition for cleansing hard races comprising:

(a) about 0.005% to about 0.1% by weight of a surfactant;

(b) about 0.01% to about 0.75% by weight of an ammonia compound;

(c) about 0.01% to about 0.70% by weight of an alcohol;

(d) balance being water;

wherein the total alcohol content is no more that about 0.08% by weight of the composition.

24. A composition for cleansing hard surfaces comprising:

(a) about 0.01% to about 0.075% by weight of a surfactant;

(b) about 0.05% to about 0.50% by weight of an ammonia compound;

(c) about 0.05% to about 0.60% by weight of an alcohol;

(d) balance being water;

wherein the total alcohol content is no more that about 40.80% by weight of the composition.

25. A composition for cleansing hard surfaces comprising:

(a) about 0.01% to about 0.05% by weight of a surfactant;

(b) about 0.07% to about 0.30% by weight of an ammonia compound;

(c) about 0.1% to about 0.50% by weight of an alcohol;

(d) balance being water;

wherein the total alcohol content no more that about 0.80% by weight of the composition.

26. The composition according to any one of claims 22–25, wherein said surfactant is selected from the group consisting of CS Surfactant, octylphenol ethoxylates, alkyl polyglycosides, sodium alkyl sulfates, and mixtures thereof; wherein CS Surfactant comprises a mixture of quaternary amines, amino oxides, and amphoteric surfactants.

27. The composition according to any one of claims 22–25, wherein said ammonia compound is selected from the group consisting of ammonia and 1-amino-2-propanol.

28. The composition according to any one of claims 22–25, wherein said alcohol is selected from ethanol, isopropanol, tetrahydrofurfuryl alcohol, 1-amino-2-propanol, and 2-butoxyethanol and mixtures thereof.

29. A method for cleaning a hard surface comprising the steps of:

(a) applying to the surface a composition according to any one of claims 1, 22–25; and (b) wiping the hard surface.

30. The method according to claim 29, wherein said hard surface is glass.

31. The method according to claim 29, wherein said method does not cause paint damage to said hard surface.

32. The method according to claim 29, wherein said hard surface is an automotive surface.

33. The method according to claim 32, wherein said automotive surface is selected from the group consisting of windshields, fenders, tires, doors, roof, hood, trunk, bumpers, trim, windows, hub caps, transportation body and heat exchangers.

34. The method according to claim 33, wherein said automotive surface is a windshield.

35. The method according to claim 34, wherein said method does not cause damage to painted surfaces surrounding said windshield.

36. The method according to claim 29, wherein said method further comprises the step of removing organic soils from said hard surface.

37. A method for evaluating the effectiveness of cleaning composition, comprising the steps of:

(a) contacting a sample with said cleaning composition, wherein said sample comprises a soil;

(b) calculating rate of penetration of said composition into said soil;

(c) calculating removal effectiveness.

* * * * *

UNITED STATES PATENT AND TRADEMARK OFFICE

CERTIFICATE OF CORRECTION

PATENT NO. : 6,881,711 B1
APPLICATION NO. : 10/046867
DATED : April 19, 2005
INVENTOR(S) : Aleksei V. Gershun et al.

It is certified that error appears in the above-identified patent and that said Letters Patent is hereby corrected as shown below:

In the Claims

Please amend claim 37 as follows:
col. 18, line 29, add the word "a" after the word "of"
--of a-- col. 18, line 34, add the word "and" after the ";"
--; and--

Signed and Sealed this
Twenty-first Day of April, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 6,881,711 C1
APPLICATION NO. : 90/012986
DATED : April 19, 2005
INVENTOR(S) : Aleksei V. Gershun, Mark V. Alexander and Colin M. Dilley It is certified that error appears in the above-identified patent and that said Letters Patent is hereby corrected as shown below:

In the Claims

Please amend claim 23 as follows:

col. 2, line 52, delete the amount “0.08%” and add the amount “0.80%”

Signed and Sealed this
Ninth Day of June, 2015

Michelle K. Lee

Michelle K. Lee
*Director of the United States Patent and Trademark Office*

US006881711C1

(12) EX PARTE REEXAMINATION CERTIFICATE (10396th)

United States Patent

Gershun et al.

(10) Number: US 6,881,711 C1

(45) Certificate Issued: Nov. 12, 2014

(54) LOW VOC CLEANING COMPOSITIONS FOR HARD SURFACES

(75) Inventors: Aleksel V. Gershun, Southbury, CT (US); Mark V. Alexander, Bridgewater, CT (US); Colin M. Dilley, Torrington, CT (US)

(73) Assignee: Credit Suisse AG, New York, NY (US)

Reexamination Request:
No. 90/012,986, Sep. 24, 2013

Reexamination Certificate for:

| | |
|---|---|
| Patent No.: | **6,881,711** |
| Issued: | **Apr. 19, 2005** |
| Appl. No.: | **10/046,867** |
| Filed: | **Oct. 26, 2001** |

(51) Int. Cl.

| | |
|---|---|
| ***C11D 3/26*** | (2006.01) |
| ***C11D 3/30*** | (2006.01) |
| ***C11D 3/02*** | (2006.01) |
| ***C11D 3/20*** | (2006.01) |
| ***C11D 3/04*** | (2006.01) |

(52) U.S. Cl.
CPC . *C11D 3/044* (2013.01); *C11D 3/30* (2013.01)
USPC ..... 510/182; 510/179; 510/180; 510/181; 510/427; 510/432; 510/505

(58) Field of Classification Search
None
See application file for complete search history.

(56) References Cited

To view the complete listing of prior art documents cited during the proceeding for Reexamination Control Number 90/012,986, please refer to the USPTO's public Patent Application Information Retrieval (PAIR) system under the Display References tab.

*Primary Examiner* — Timothy Speer

(57) ABSTRACT

The present invention relates generally to compositions and methods for cleaning hard surfaces. More particularly, the present invention relates to cleaning compositions which can be used in automotive applications for removing organic soils that accumulate on automotive surfaces without causing surface paint damage. Such cleaning compositions of the present invention are environmentally safe and contain no or low amounts of volatile organic compounds.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 12 is cancelled.

Claims 1-5, 8-11, 13-17, 21-25, 27 and 28 are determined to be patentable as amended.

Claims 6, 7, 18-20, 26 and 29-36, dependent on an amended claim, are determined to be patentable.

New claims 38-53 are added and determined to be patentable.

Claim 37 was not reexamined.

1. A composition for cleaning hard surfaces [comprising] *consisting of*:

(a) about 0.001% to about 0.5% by weight of a surfactant;

(b) about 0.001% to about 2% by weight of an ammonia compound*, wherein the ammonia compound is selected from the group consisting of ammonia, ammonium carbamate, ammonium carbonate, ammonium bicarbonate, ammonium hydroxide, ammonium borate, and ammonium phosphate*;

(c) about 0.001% to about 0.80% by weight of an alcohol; and (d) *optionally a dye, enzyme, fragrance, antifoaming agent, thickening agent, and combinations thereof;*

(*e*) balance being water, wherein the total alcohol content is no more than about 0.80% by weight of the composition.

2. The composition according to claim 1, wherein said composition [comprises] *consists of* about 0.001 to about 0.25% by weight of surfactant.

3. The composition according to claim 1, wherein said composition [comprises] *consists of* about 0.005% to about 0.1% by weight of surfactant.

4. The composition according to claim 1, wherein said composition [comprises] *consists of* about 0.01% to about 0.075% by weight of surfactant.

5. The composition according to claim 1, wherein said composition [comprises] *consists of* about 0.01% to about 0.05% by weight of surfactant.

8. The composition according to claim 1, wherein said composition [comprises] *consists of* about 0.005% to about 1.0% by weight of the ammonia compound.

9. The composition according to claim 1, wherein said composition [comprises] *consists of* about 0.01% to about 0.75% by weight of the ammonia compound.

10. The composition according to claim 1, wherein said composition [comprises] *consists of* about 0.05% to about 0.50% by weight of the ammonia compound.

11. The composition according to claim 1, wherein said composition [comprises] *consists of* about 0.07% to about 0.30% by weight of the ammonia compound.

13. The composition according to claim 1, wherein said ammonia compound is [selected from the group consisting of] ammonia[,_ammonium hydroxide, and alkanolamine having 1 to 6 carbon atoms].

14. The composition according to claim 1, wherein said composition [comprises] *consists of* about 0.005% to about 0.08% by weight alcohol.

15. The composition according to claim 1, wherein said composition [comprises] *consists of* about 0.01% to about 0.70% by weight alcohol.

16. The composition according to claim 1, wherein said composition [comprises] *consists of* about 0.05% to about 0.60% by weight alcohol.

17. The composition according to claim 1, wherein said composition [comprises] *consists of* about 0.1% to about 0.50% by weight alcohol.

21. The composition according to claim 1, wherein [said composition further comprises] *the enzyme is* one or more enzymes selected from the group consisting of protease, cellulase, chitinase, lipase, and amylase.

22. A composition for cleaning hard surfaces [comprising] *consisting of*:

(a) about 0.001% to about 0.25% by weight of a surfactant;

(b) about 0.005% to about 1.0% by weight of an ammonia compound*, wherein the ammonia compound is selected from the group consisting of ammonia, ammonium carbamate, ammonium carbonate, ammonium bicarbonate, ammonium hydroxide, ammonium borate, and ammonium phosphate*;

(c) about 0.005% to about 0.80% by weight of an alcohol;

(d) *optionally a dye, enzyme, fragrance, antifoaming agent, thickening agent, and combinations thereof;*

(*e*) balance being water, wherein the total alcohol content is no more than about 0.80% by weight of the composition.

23. A composition for cleaning hard surfaces [comprising] *consisting of*:

(a) about 0.005% to about 0.1% by weight of a surfactant;

(b) about 0.01% to about 0.75% by weight of an ammonia compound*, wherein the ammonia compound is selected from the group consisting of ammonia, ammonium carbamate, ammonium carbonate, ammonium bicarbonate, ammonium hydroxide, ammonium borate, and ammonium phosphate*;

(c) about 0.01% to about 0.70% by weight of an alcohol;

(d) *optionally a dye, enzyme, fragrance, antifoaming agent, thickening agent, and combinations thereof;*

(*e*) balance being water;

wherein the total alcohol content is no more that about 0.08% by weight of the composition.

24. A composition for cleansing hard surfaces [comprising] *consisting of*:

(a) about 0.01% to about 0.075% by weight of a surfactant;

(b) about 0.05% to about 0.50% by weight of an ammonia compound*, wherein the ammonia compound is selected from the group consisting of ammonia, ammonium carbamate, ammonium carbonate, ammonium bicarbonate, ammonium hydroxide, ammonium borate, and ammonium phosphate*;

(c) about 0.05% to about 0.60% by weight of an alcohol;

(d) *optionally a dye, enzyme, fragrance, antifoaming agent, thickening agent, and combinations thereof;*

(*e*) balance being water;

wherein the total alcohol content is no more that about [40.80%] *0.80%* by weight of the composition.

25. A composition for cleansing hard surfaces [comprising] *consisting of*:

(a) about 0.01% to about 0.05% by weight of a surfactant;

(b) about 0.07% to about 0.30% by weight of an ammonia compound, *wherein the ammonia compound is selected from the group consisting of ammonia, ammonium carbamate, ammonium carbonate, ammonium bicarbonate, ammonium hydroxide, ammonium borate, and ammonium phosphate*;

(c) about 0.1% to about 0.50% by weight of an alcohol;

(d) *optionally a dye, enzyme, fragrance, antifoaming agent, thickening agent, and combinations thereof;*

(*e*) balance being water;

wherein the total alcohol content no more that about 0.80% by weight of the composition.

27. The composition according to any one of claims 22-25, wherein said ammonia compound is [selected from the group consisting of] ammonia [and 1-amino-2- propanol].

28. (amended), The composition according to any one of claims 22-25, wherein said alcohol is selected from ethanol, isopropanol, tetrahydrofurfuryl alcohol, 1-amino-2-propanol, [and] 2-butoxyethanol, and mixtures thereof.

*38. The composition according to claim 1, wherein the alcohol comprises methanol and ethanol.*

*39. The composition according to claim 22, wherein the alcohol comprises methanol and ethanol.*

*40. The composition according to claim 23, wherein the alcohol comprises methanol and ethanol.*

*41. The composition according to claim 24, wherein the alcohol comprises methanol and ethanol.*

*42. The composition according to claim 25, wherein the alcohol comprises methanol and ethanol.*

*43. The composition according to claim 1, wherein the ammonia compound is ammonium hydroxide.*

*44. The composition according to claim 22, wherein the ammonia compound is ammonium hydroxide.*

*45. The composition according to claim 23, wherein the ammonia compound is ammonium hydroxide.*

*46. The composition according to claim 24, wherein the ammonia compound is ammonium hydroxide.*

*47. The composition according to claim 25, wherein the ammonia compound is ammonium hydroxide.*

*48. The composition according to claim 1, wherein the ammonia compound is an amount of about 0.005% to about 1.0% by weight of $NH_3$.*

*49. The composition according to claim 22, wherein the ammonia compound in an amount of about 0.005% to about 1.0% by weight of $NH_3$.*

*50. The composition according to claim 23, wherein the ammonia compound in an amount of about 0.005% to about 1.0% by weight of $NH_3$.*

*51. The composition according to claim 24, wherein the ammonia compound in an amount of about 0.005% to about 1.0% by weight of $NH_3$.*

*52. The composition according to claim 25, wherein the ammonia compound in an amount of about 0.005% to about 1.0% by weight of $NH_3$.*

*53. A composition for cleaning hard surfaces consisting of:*

*(a) about 0.001% to about 0.5% by weight of a surfactant;*

*(b) about 0.001% to about 2% by weight of ammonium hydroxide;*

*(c) about 0.001% to about 0.80% by weight of an alcohol;*

*(d) a dye;*

*(e) a fragrance;*

*(f) an antifoaming agent; and*

*(e) balance being water,*

*wherein the total alcohol content is no more that about 0.8% by weight of the composition.*

* * * * *